US009117573B2

(12) United States Patent
McLane et al.

(10) Patent No.: US 9,117,573 B2
(45) Date of Patent: Aug. 25, 2015

(54) INTEGRATED WIRE CABLE TWISTING, WRAPPING, AND TESTING APPARATUS AND METHOD OF OPERATING SAME

(71) Applicant: DELPHI TECHNOLOGIES, INC., Troy, MI (US)

(72) Inventors: John C. McLane, Girard, OH (US); John Thomas Kightlinger, Canfield, OH (US); Robert Alan McFall, West Farmington, OH (US); Keith B. Adkins, Warren, OH (US); Donald L. McConnell, Cortland, OH (US); David R. Peterson, Aurora, OH (US)

(73) Assignee: Delphi Technologies, Inc., Troy, MI (US)

( * ) Notice: Subject to any disclaimer, the term of this patent is extended or adjusted under 35 U.S.C. 154(b) by 271 days.

(21) Appl. No.: 13/905,553

(22) Filed: May 30, 2013

(65) Prior Publication Data

US 2014/0352867 A1 Dec. 4, 2014

(51) Int. Cl.

| | |
|---|---|
| ***H01B 13/26*** | (2006.01) |
| ***H01B 13/08*** | (2006.01) |
| ***H01B 13/02*** | (2006.01) |
| ***H01B 13/22*** | (2006.01) |

(52) U.S. Cl.

CPC ..... *H01B 13/26* (2013.01); *H01B 13/02* (2013.01); *H01B 13/085* (2013.01); *H01B 13/227* (2013.01)

(58) Field of Classification Search

CPC ..... H01B 13/26; H01B 13/085; H01B 13/02; H01B 13/227

USPC ..... 156/148, 185, 188; 140/149

See application file for complete search history.

(56) References Cited

U.S. PATENT DOCUMENTS 3,616,531 A * 11/1971 Tyler ..... 140/149
3,847,190 A * 11/1974 Forester ..... 140/149

(Continued)

FOREIGN PATENT DOCUMENTS

DE 32 11 428 A1 10/1983
DE 29721664 U1 * 2/2000

(Continued)

OTHER PUBLICATIONS

Komax Wire Division, Komax Holding AG, bt188T/bt288 Semiautomatic Twisters Brochure, http://www.komaxgroup.com/~/media/Wire/Files/Downloads/Sale%20Doc/0326623_0_PRO_bt188T_288_EN.pdf.

(Continued)

*Primary Examiner* — Jeff Aftergut
(74) *Attorney, Agent, or Firm* — Robert J. Myers

(57) ABSTRACT

A single machine configured to manufacture a wire cable assembly including an twisted wire pair and a drain wire having a conductive tape and an insulative tape spirally wrapped about said wire pair. The machine includes a first clamp that secures an end of the wire pair and a second clamp that secures the other end of the wire pair. The second clamp rotates while the first clamp is fixed thereby twisting the wires of the wire pair one about the other. The second clamp can also rotate synchronously with the first clamp thereby rotating the wire pair without twisting. The machine also has a tape reel configured to move parallel to the clamps as they rotate, wrapping tape around the wire pair. The apparatus can be configured to apply the tapes simultaneously to electromagnetically shield and insulate the cable assembly. A method of operating the apparatus is also provided.

15 Claims, 13 Drawing Sheets

(56) References Cited

U.S. PATENT DOCUMENTS

| | | | | |
|---|---|---|---|---|
| 3,957,092 | A * | 5/1976 | Loy et al. | 140/149 |
| 5,564,268 | A | 10/1996 | Thompson | |
| 5,931,203 | A * | 8/1999 | Kredler et al. | 140/149 |
| 6,289,944 | B1 | 9/2001 | Frommenwiler | |

FOREIGN PATENT DOCUMENTS

| | | | |
|---|---|---|---|
| DE | 10107670 | A1 * | 9/2002 |
| DE | 202009004913 | U1 * | 8/2010 |
| WO | 2013/068990 | A1 | 5/2013 |

OTHER PUBLICATIONS

CAM Innovation, RHT Spiral Raping Machine Web Page, http://www.caminnovation.com/en/wire-harness-taping-eguipment/spiral-taping/22-rht-spiral-taping-machine.html.

European Search Report dated Oct. 10, 2014.

* cited by examiner

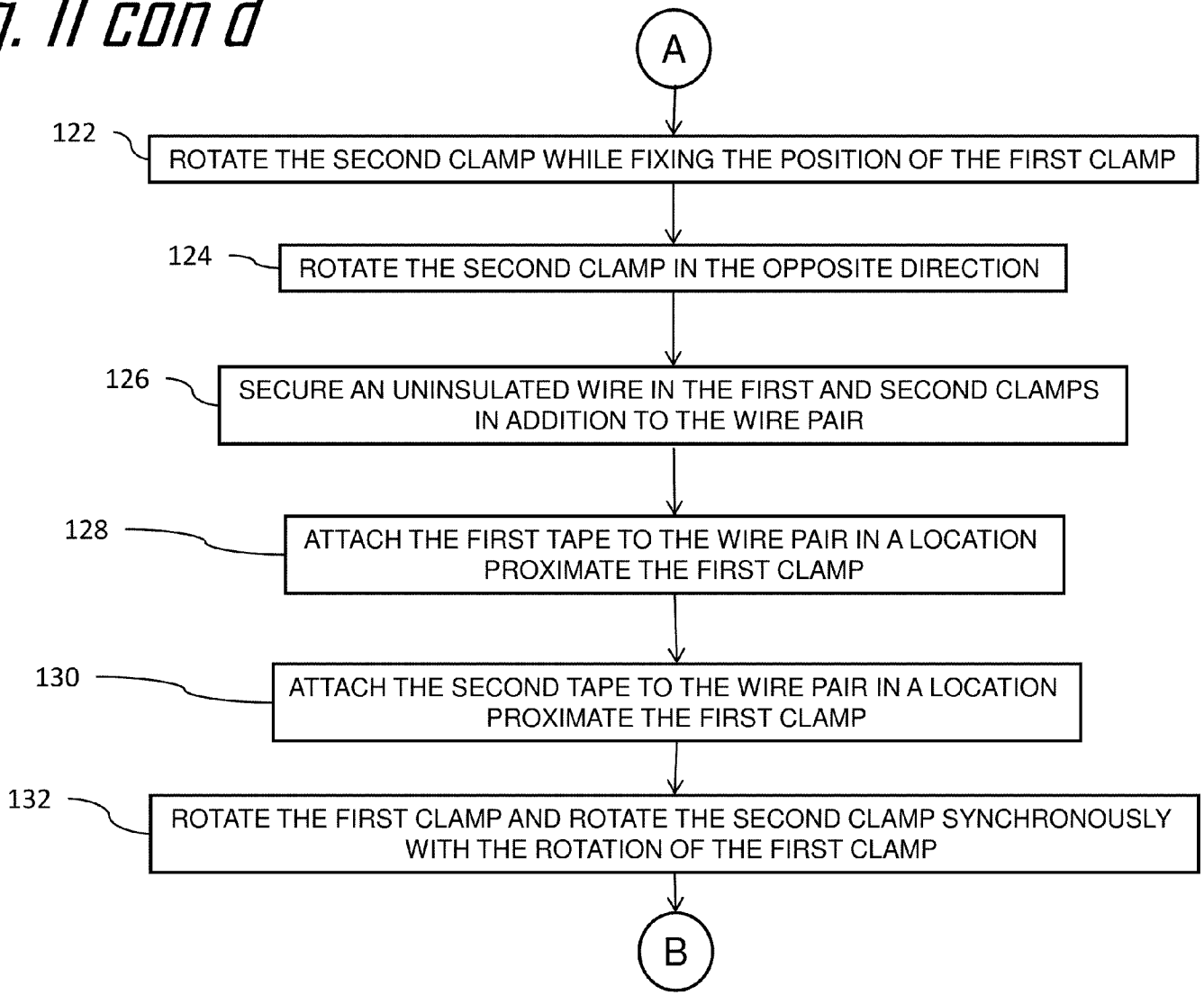
Fig. 11 con'd

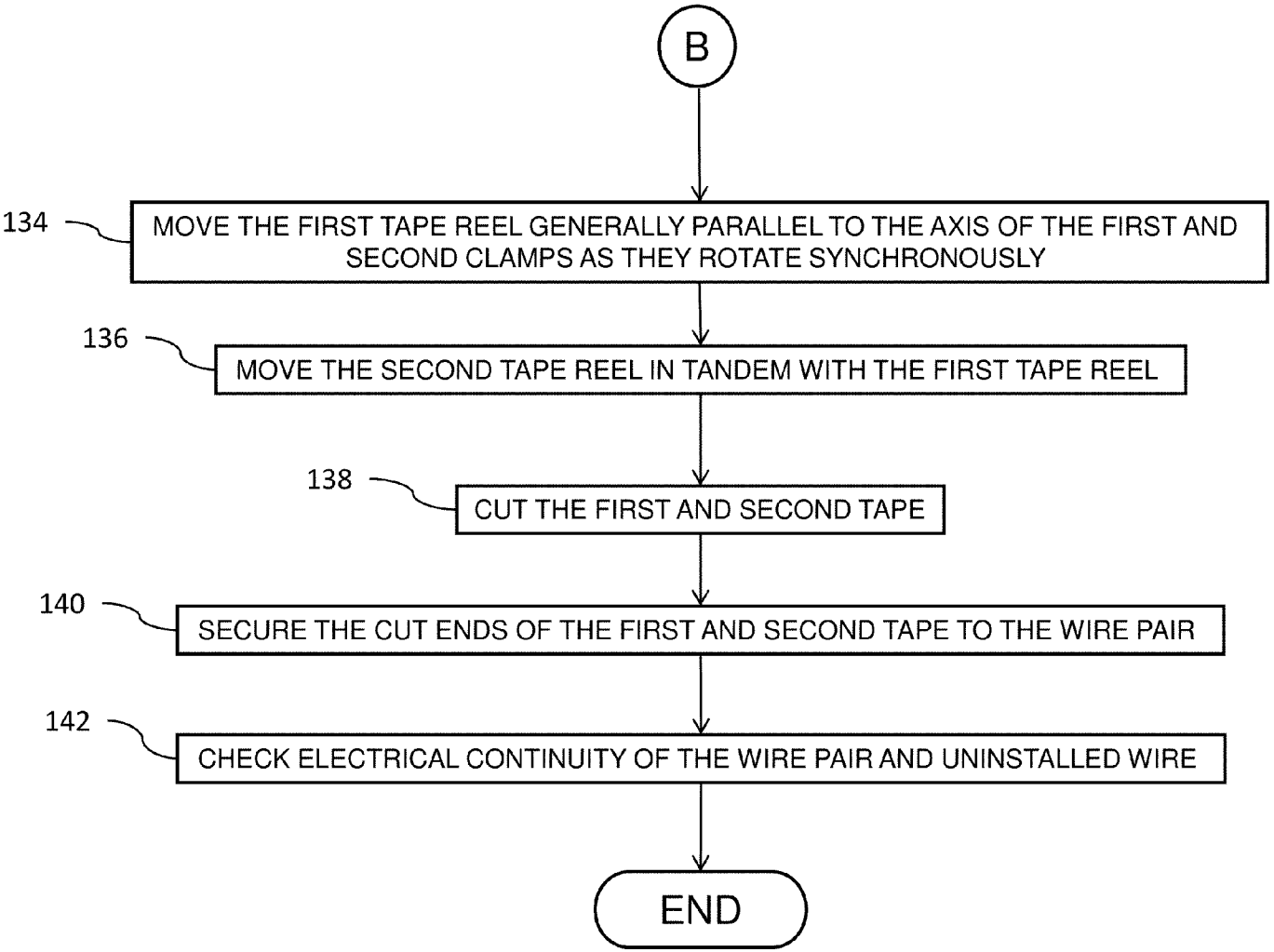
Fig. 11 con'd

INTEGRATED WIRE CABLE TWISTING, WRAPPING, AND TESTING APPARATUS AND METHOD OF OPERATING SAME

TECHNICAL FIELD OF THE INVENTION

The invention generally relates to electrical wire cable manufacturing machines, and more particularly relates to a machine configured to automatically twist and wrap a twisted pair cable.

BACKGROUND OF THE INVENTION

Insulated twisted wire pair cables are typically used in wiring harness to provide a signal path that resistant to electromagnetic interference. Twisted wire pair cables used in automotive wire harnesses may also include an uninsulated "drain" wire and are wrapped in a conductive tape or foil that provides an electromagnetic shield. The conductive tape is then overwrapped with an insulative tape. Typically two machines are used to manufacture twisted pair wire harnesses. First wire leads are fed into a post twister machine that twists two or more wires to have a specific pitch or number of twists per unit length, e.g. twists per meter. The twisted wire pair along with the drain wire are then run through a dual taper machine, so named because it applies both the conductive tape and insulative tape to the wires at the same time. The dual taper machine spirally wraps the wires with the conductive tape and insulative tape. Using two machines to manufacture the wire harness undesirably creates in-process inventory that requires storage space and is subject to loss or damage. It is typically difficult to attach the conductive tape and the insulative tape to the twisted pair. The operator may be required to place the conductive tape and insulative tape between the twists of the wire pair and have to manually rotate the cable multiple times to ensure the wires do not rotate while initiating the taping process.

The dual taper machine typically uses feed wheels to pull the wires through the machine as the tape is applied. The pressure of the feed wheels on the wire pair provides an opportunity to damage the twisted wire pair. The operator may be required to pull the twisted pair wires though the dual taper machine before the feed wheels are engaged, providing another opportunity for damage. The drain wire is typically fed into the dual taper machine from a spool. As the wires are pulled through the dual taper machine the drain wire can tangle and become wrapped around the wire pair in such a way as to pinch through the insulation of the wire pair, causing a product failure.

Damage to the insulated twisted wire pair that occurs during the manufacturing process or prior to the manufacturing process can create a failure when the wiring harness is used in the vehicle. Therefore, a facility to electrically test the twisted pair to ensure manufacturing quality is desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, an apparatus configured to manufacture a wire cable assembly including an insulated twisted wire pair having a tape spirally wrapped about said wire pair is provided. The apparatus includes a first clamp to secure a first end of the wire pair. The first clamp is configured to rotate or maintain a fixed position. The apparatus also includes a second clamp to secure a second end of the wire pair. The second clamp axially opposed to the first clamp. The second clamp is also configured to rotate while the first clamp maintains the fixed position thereby twisting the wires of the wire pair one about the other or to rotate synchronously with the rotation of the first clamp thereby rotating the wire pair without further twisting wire pair. In addition, the second clamp may be configured to maintain a fixed position and the first clamp may be configured to rotate while the second clamp maintains the fixed position thereby twisting the wires of the wire pair one about the other. The first and second clamps may be further configured to secure an uninsulated drain wire in addition to the wire pair. The apparatus may include a first servo motor that is mechanically coupled to the first clamp and is configured to rotate the first clamp and a second servo motor that is mechanically coupled to the second clamp and is configured to rotate the second clamp.

The apparatus further includes a first tape reel that holds a first tape. The first tape reel is configured to move generally parallel to the axis of the first and second clamps when they rotate synchronously thereby wrapping the first tape around the wire pair. The apparatus may also include a second tape reel that holds a second tape. The second tape reel is configured to move in tandem with the first tape reel, thereby also wrapping the second tape around the wire pair. The apparatus may include a third servo motor that is mechanically coupled to the first tape reel and is configured to move the first tape reel in the direction generally parallel to the axis of the first and second clamps.

The apparatus may also include an electrical continuity tester configured to check electrical continuity of the wire pair and drain wire after the first tape is applied.

In another embodiment of the present invention, a method of manufacturing a wire cable assembly including an insulated twisted wire pair having a tape spirally wrapped about said wire pair is provided. The method includes the steps of providing a first clamp configured to secure a first end of the wire pair, providing a second clamp axially opposed to the first clamp configured to secure a second end of the wire pair, and providing a first tape reel holding a first tape. The method also includes the steps of securing the first end in the first clamp, securing the second end in the second clamp, and attaching an end of the first tape to the wire pair proximate the first clamp. The method further includes the steps of rotating the second clamp while fixing the position of the first clamp, thereby twisting the wires of the wire pair one about the other, securing the end of the first tape within the wire pair, rotating the first clamp, and rotating the second clamp synchronously with the rotation of the first clamp thereby rotating the wire pair without twisting. The method additionally includes the steps of moving the first tape reel in a direction generally parallel to the axis of the first and second clamps as they rotate synchronously thereby wrapping the first tape around the wire pair.

The method may also include the steps of providing a second tape reel holding a second tape, attaching an end of the second tape to the wire pair in the location proximate the first clamp, rotating the second clamp while fixing the position of the first clamp, thereby securing the end of the second tape within the wire pair, and moving the second tape reel in tandem with the first tape reel from a location proximate the first clamp to a location proximate the second clamp thereby wrapping the second tape around the wire pair.

Following the step of rotating the second clamp while fixing the position of the first clamp, the method may include the step of rotating the second clamp in the opposite direction thereby relieving wire stress in the wire pair and/or the step of securing an uninsulated drain wire in the first and second clamps in addition to the wire pair.

Following the step of moving the second tape reel in tandem with the first tape reel, the method may further include the steps of cutting the first and second tape and securing the cut ends of the first and second tape to the wire pair.

Following the step of moving the first tape reel in a direction generally parallel to the axis of the first and second clamps, the method may include the step of checking electrical continuity of the wire pair.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Presented herein is a single machine designed to manufacture a wire cable assembly that includes an insulated twisted wire pair having a tape spirally wrapped about the wire pair. The machine is also capable of manufacturing a wire cable assembly that additionally includes a non-insulated drain wire and is additionally wrapped with an electrically conductive foil or tape to provide an electromagnetic shield around the twisted wire pair. A method of manufacturing this wire cable using this machine is also presented herein.

Figure 1:
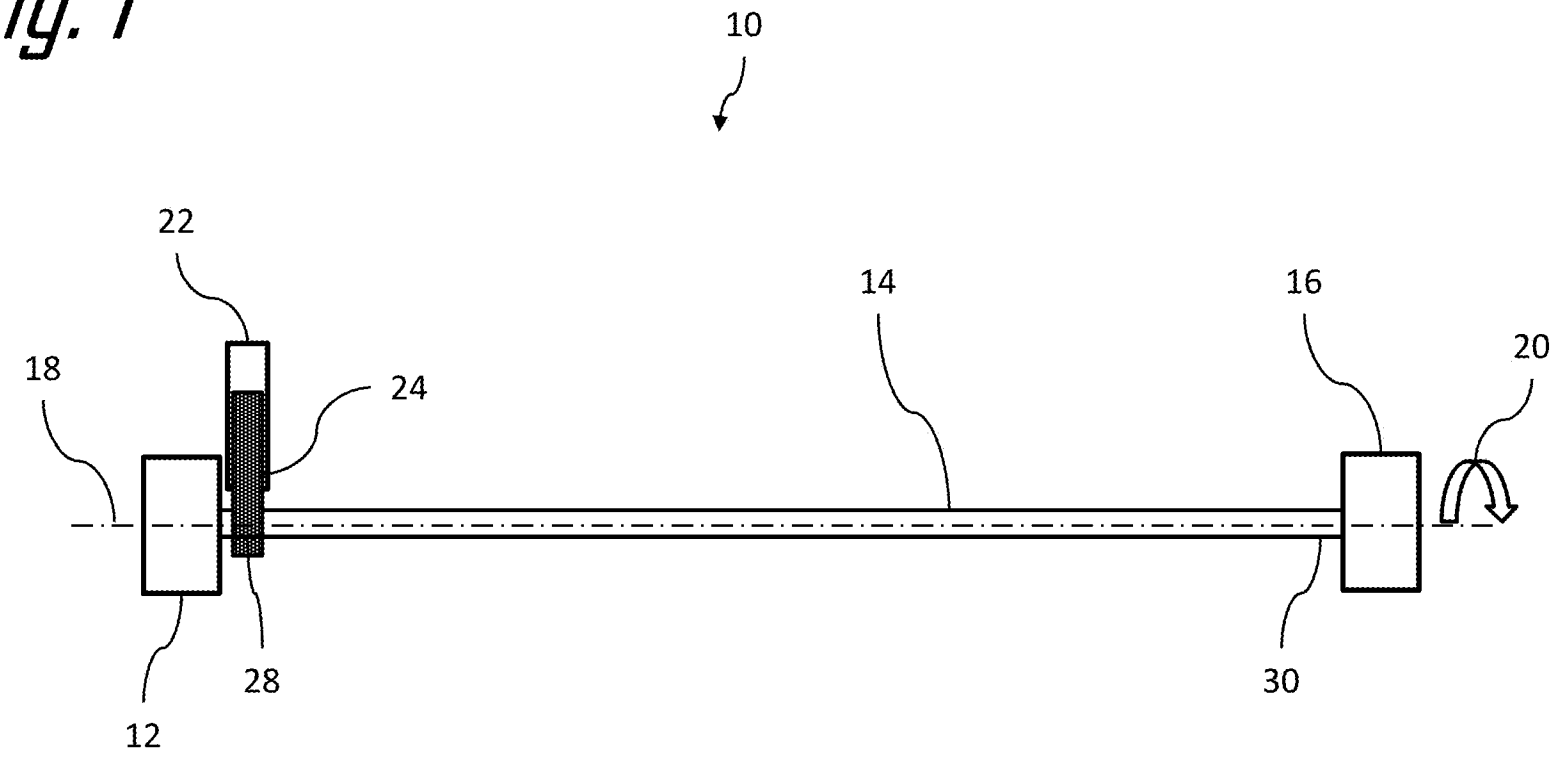
FIG. 1 is a schematic diagram of an apparatus configured to manufacture a wire cable assembly including an insulated twisted wire pair having a tape spirally wrapped about said wire pair in the process of twisting the wire pair in accordance with one embodiment.

FIG. 1 illustrates a non-limiting example of an integrated wire cable twisting, wrapping, and testing machine 10 or apparatus 10, hereafter the apparatus 10. The illustrations of FIGS. 1-5 are schematic representations to simplify the explanation of the elements of the apparatus 10. Detailed illustrations of the apparatus 10 are found in FIGS. 6-10. The apparatus 10 is designed to manufacture a wire cable assembly that includes an insulated twisted wire pair with a tape spirally wrapped about the wire pair. This type of wire cable is typically referred to as an unshielded twisted pair. The apparatus 10 includes a first wire chuck or first clamp 12 that is configured to hold or secure one end of a pair of insulated wires 14 and a second wire chuck or second clamp 16 configured to hold or secure the other end of the wire pair 14. The wire pair 14 is held substantially taut between the first and second clamps 12, 16. The first and second clamps 12, 16 may be designed to hold terminated wire ends, i.e. wire ends having terminals or contacts attached and/or the clamps may be designed to hold unterminated wire ends. The second clamp 16 is axially opposed to the first clamp 12.

The first clamp 12 is constructed to be locked in a fixed position so that it does not rotate. The second clamp 16 is designed to rotate about the axis 18 between the first and second clamp 16 the direction 20 while the first clamp 12 remains locked in the fixed position, thereby twisting the wires of the wire pair 14 one about the other. The number of rotations and the speed of rotation are controlled in order to provide the proper pitch or twists per unit length of the twisted wire pair 14. The first clamp 12 is also configured to rotate about the axis 18 between the first and second clamp 16. The first clamp 12 is configured to rotate in the direction 20 synchronously with the rotation of the second clamp 16 thereby rotating the wire pair 14 without further twisting or untwisting the wire pair 14.

Figure 2:
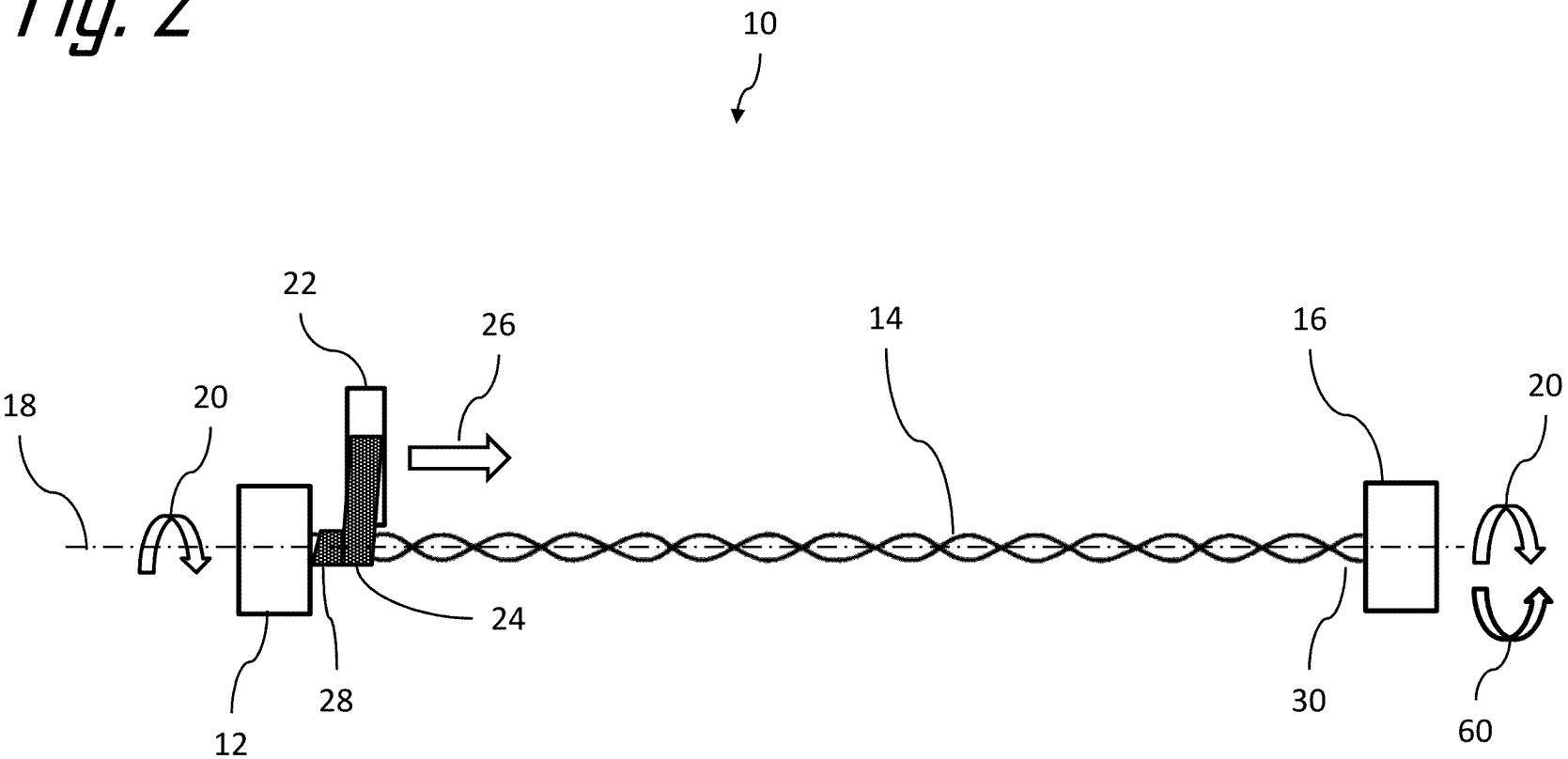
FIG. 2 is a schematic diagram of the apparatus of FIG. 1 in the process of wrapping the tape about the wire pair in accordance with one embodiment.

The apparatus 10 also includes first tape reel 22 that holds a first tape 24. As illustrated in FIG. 2, the first tape reel 22 is attached to a transport mechanism (not shown in FIGS. 1-5) configured to move the first tape reel 22 in a lateral direction 26 that is generally parallel to the axis 18 of the first and second clamps 12, 16 when they rotate synchronously. The first tape 24 is attached to the wire pair 14 and as the wire pair 14 rotates, thereby enmeshing the end of the first tape 24 in the twists of the wire pair 14. As the first tape reel 22 moves in the lateral direction 26 and the wire pair 14 is rotated by the first and second clamps 12, 16, the first tape 24 is wrapped around the wire pair 14. The first tape reel 22 moves from a first location 28 near the first clamp 12 to a second location 30 near the second clamp 16.

Figure 3:
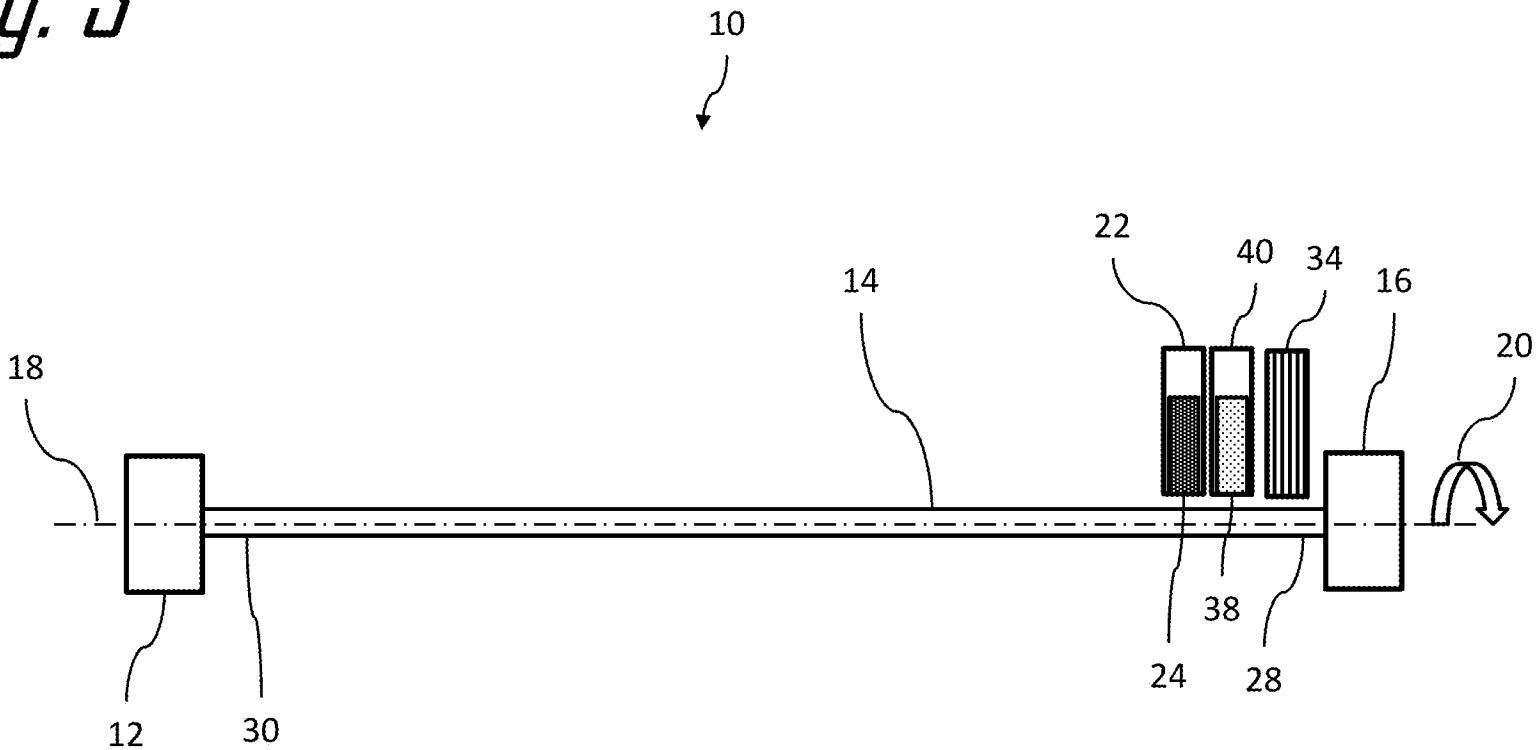
FIG. 3 is a schematic diagram of the apparatus of FIG. 1 further configured to manufacture a wire cable assembly including an insulated twisted wire pair and an uninsulated drain wire having a first and second tape spirally wrapped about said wire pair and drain wire in the process of twisting the wire pair in accordance with one embodiment.

FIG. 3 illustrates a non-limiting example of the apparatus 10 configured to manufacture a wire cable assembly that includes an insulated twisted wire pair 14 and an uninsulated drain wire 32 that is spirally wrapped by a conductive second tape 38 and an insulative or dielectric first tape 24. This type of wire cable is typically referred to as a shielded twisted pair. The wire pair 14 is secured in the first and second clamps 12, 16 and the second clamp 12 is rotated in the direction 20 while the first clamp 12 remains locked in the fixed position, thereby twisting the wires of the wire pair 14 one about the other.

Figure 4:
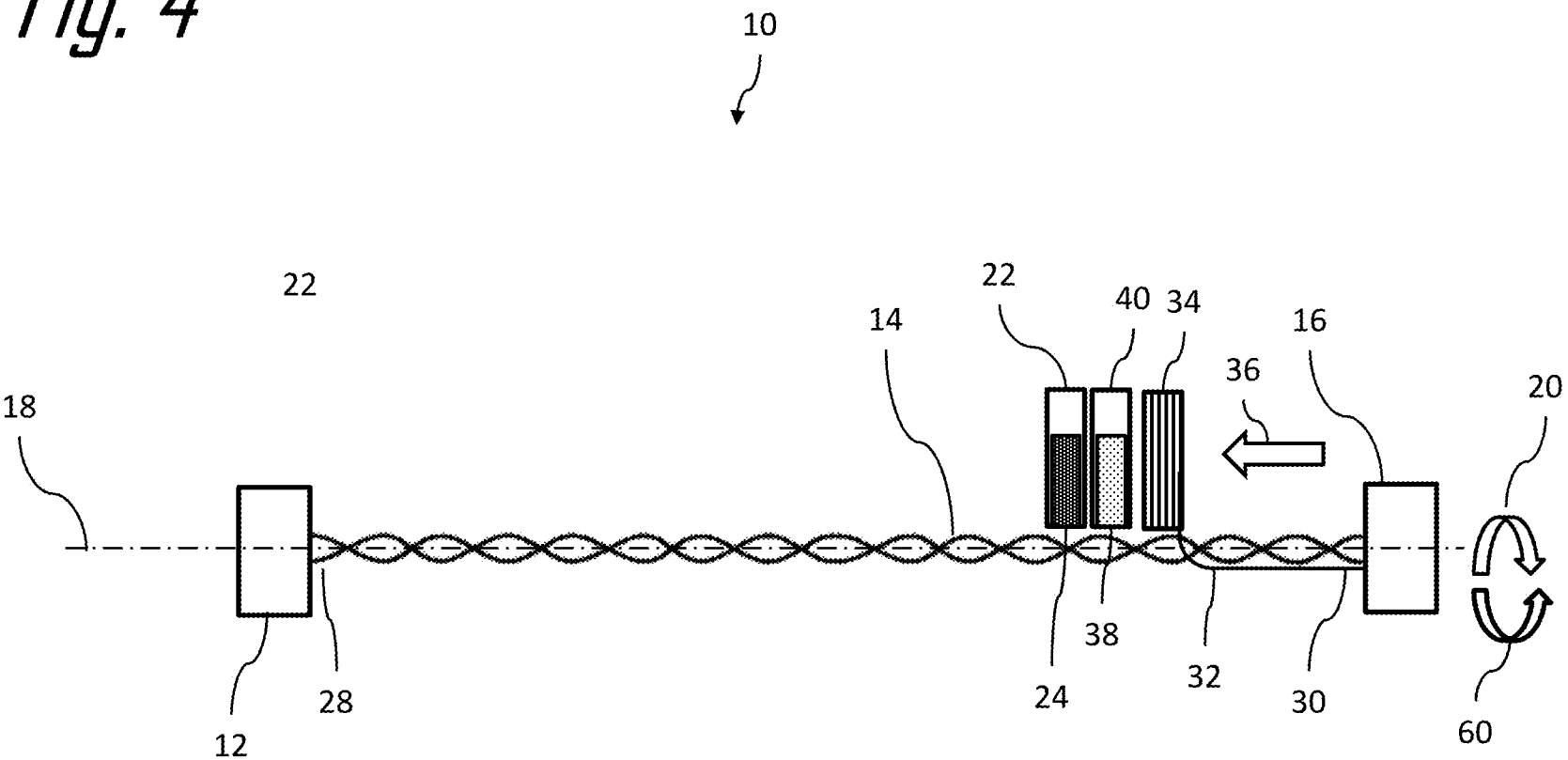
FIG. 4 is a schematic diagram of the apparatus of FIG. 3 in the process of attaching the drain wire in accordance with one embodiment.

As illustrated in FIG. 4, the apparatus 10 further includes a drain wire spool 34 that is attached to the transport mechanism, which is configured to move the drain wire spool 34 in a lateral direction 36 that is generally parallel to the axis 18 of the first and second clamps 12, 16. The second clamp 12 is designed to hold or secure the drain wire 32 in addition to the wire pair 14. The drain wire 32 is typically secured within the second clamp 12 after the wire pair 14 is twisted together. The transport mechanism then moves the drain wire spool 34 in the lateral direction 36 from the first location to the second location applying the drain wire 32 to the twisted wire pair 14. The second clamp 12 may be rotated in the direction 20 for a few revolutions while the drain wire spool 34 in moving to the second location 30 thereby wrapping the drain wire 32 about the twisted wire pair 14 and prevent sagging of the drain wire 32. When the drain wire spool 34 reaches the second location 30, the drain wire 32 is cut from the drain wire spool 34 and the drain wire 32 is secured in the first clamp 12.

Figure 5:
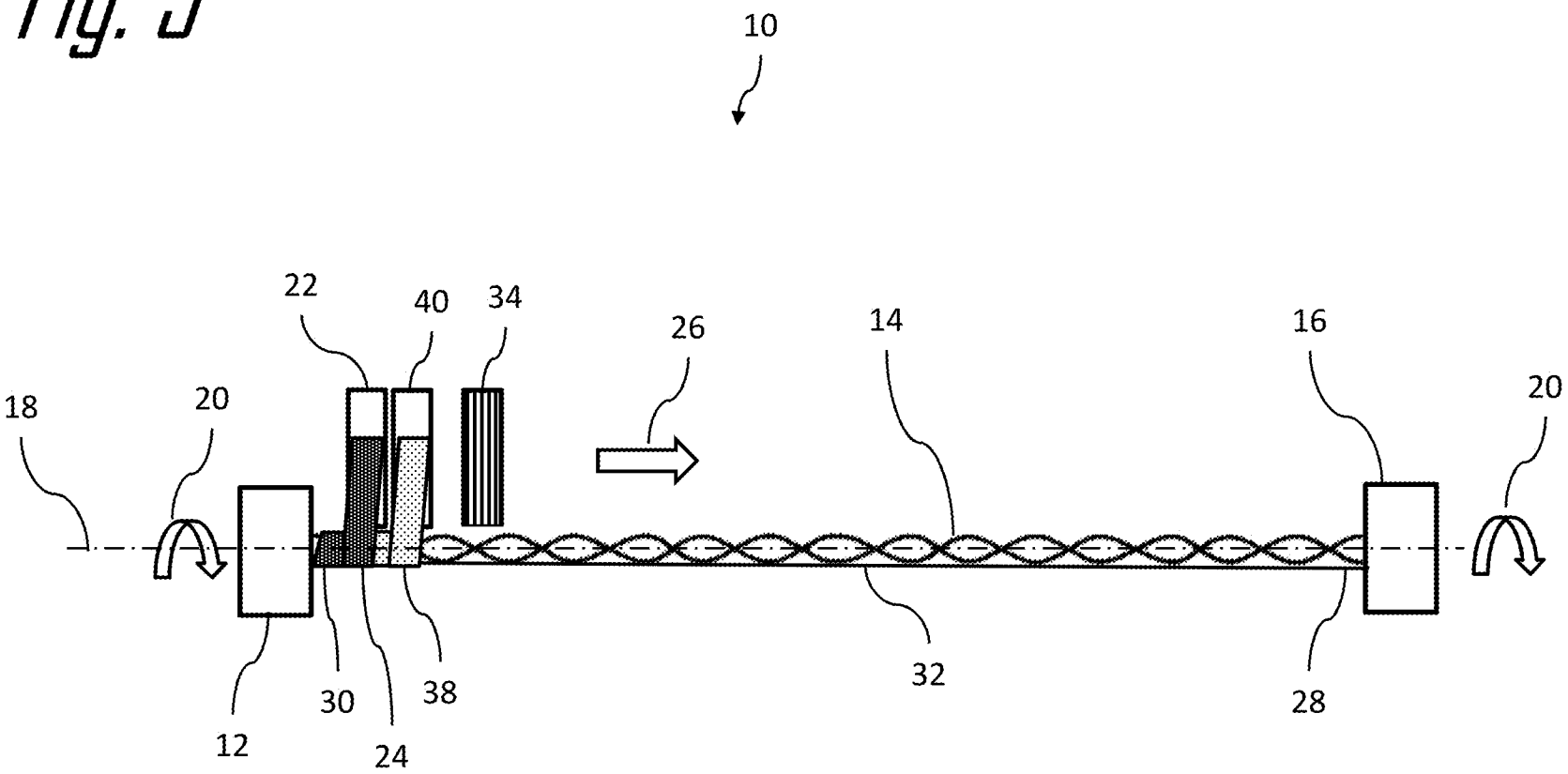
FIG. 5 is a schematic diagram of the apparatus of FIG. 3 in the process of wrapping the first and second tape about the wire pair and drain wire in accordance with one embodiment.
Figure 6:
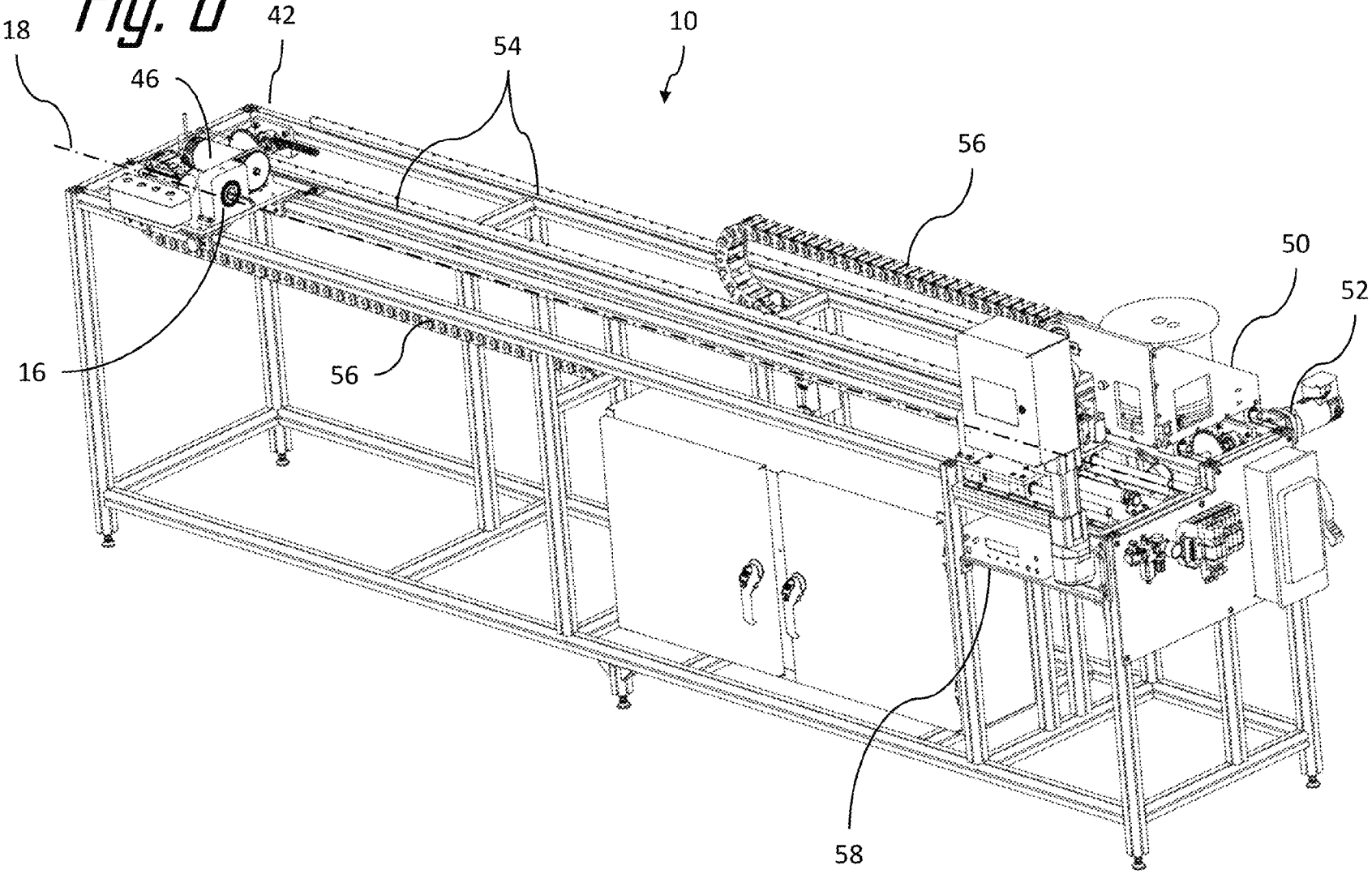
FIG. 6 is a detailed perspective view of the apparatus of FIG. 1 in accordance with one embodiment.
Figure 7:
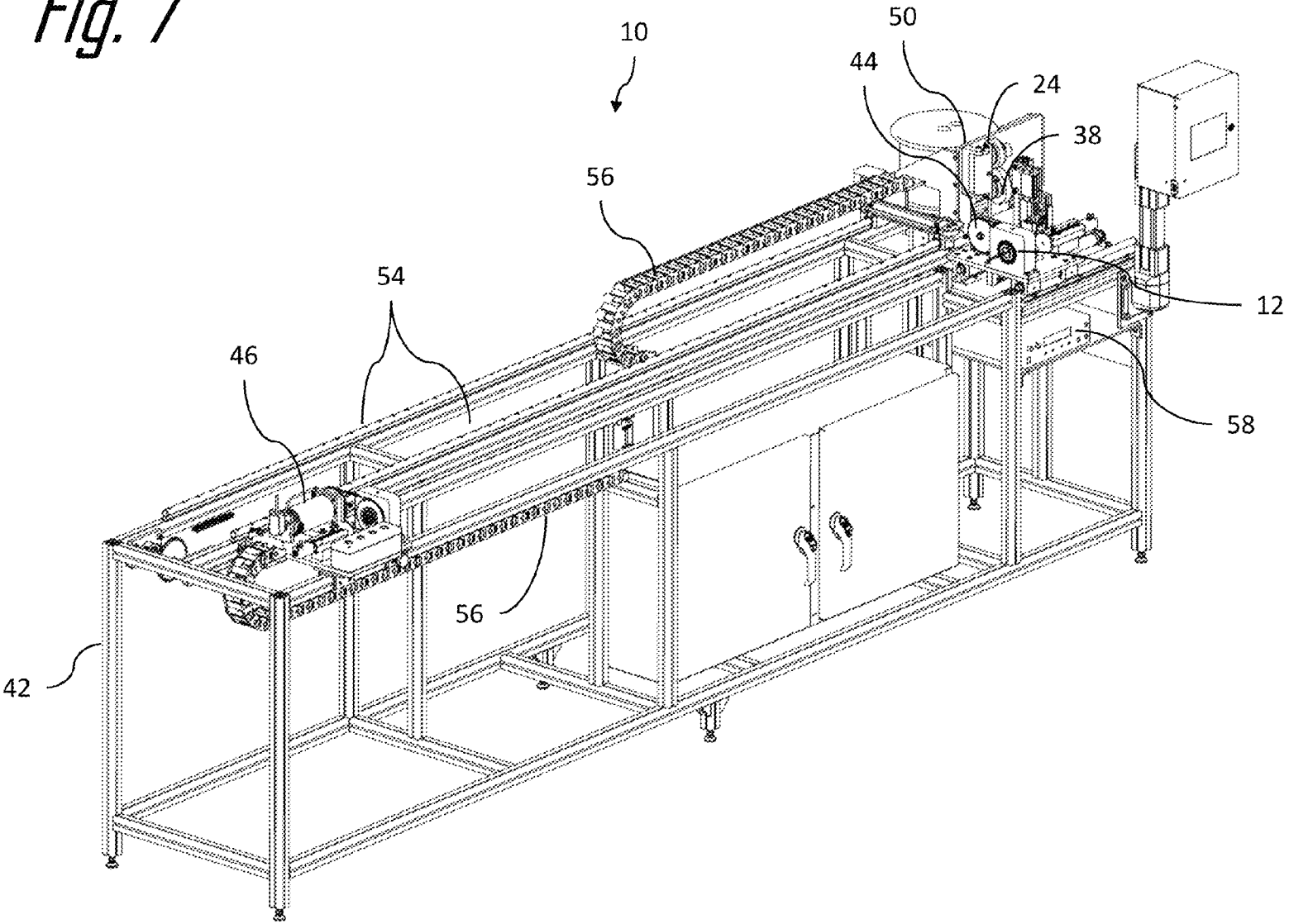
FIG. 7 is an alternate detailed perspective view of the apparatus of FIG. 1 in accordance with one embodiment.
Figure 8:
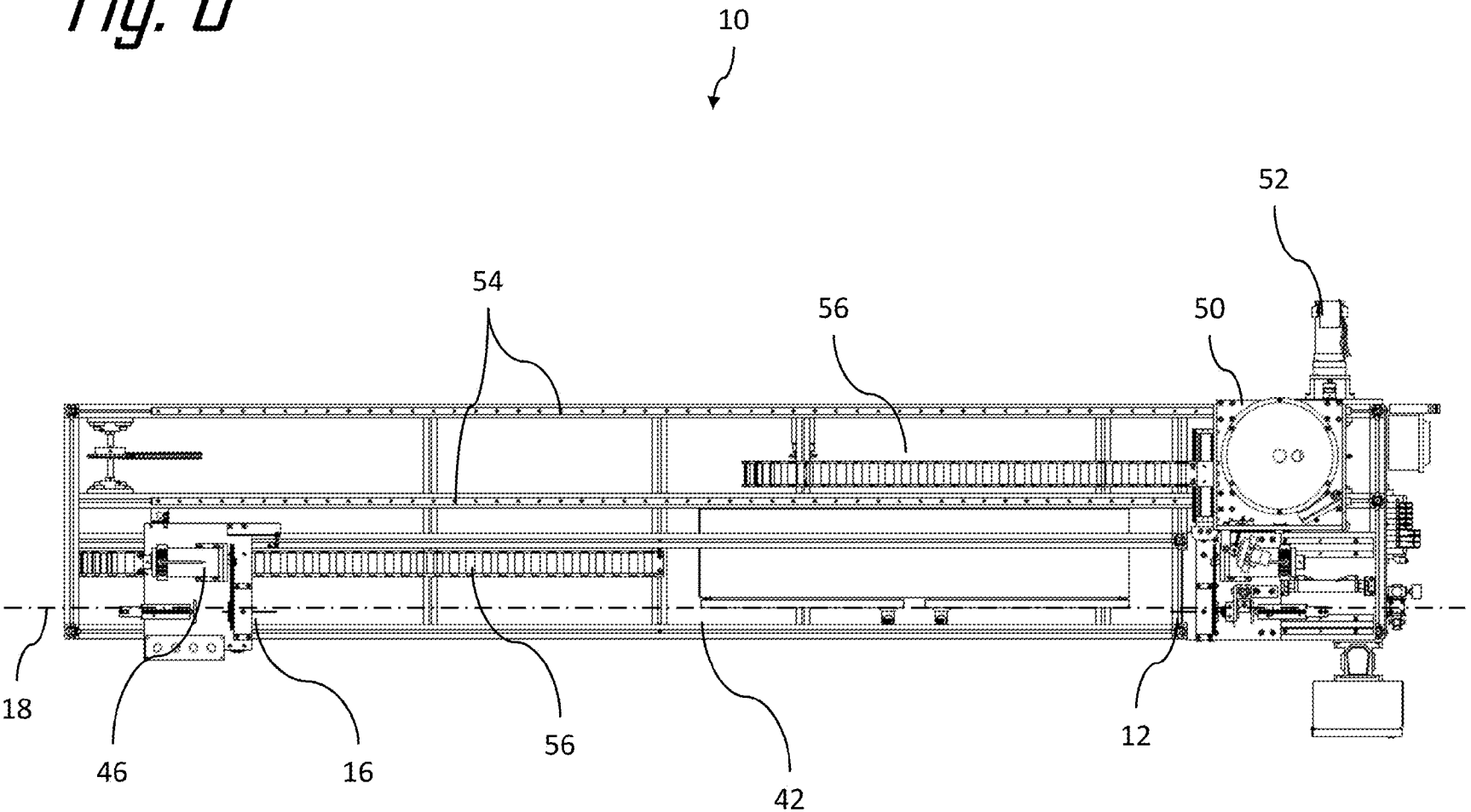
FIG. 8 is a detailed top view of the apparatus of FIG. 1 in accordance with one embodiment.
Figure 9:
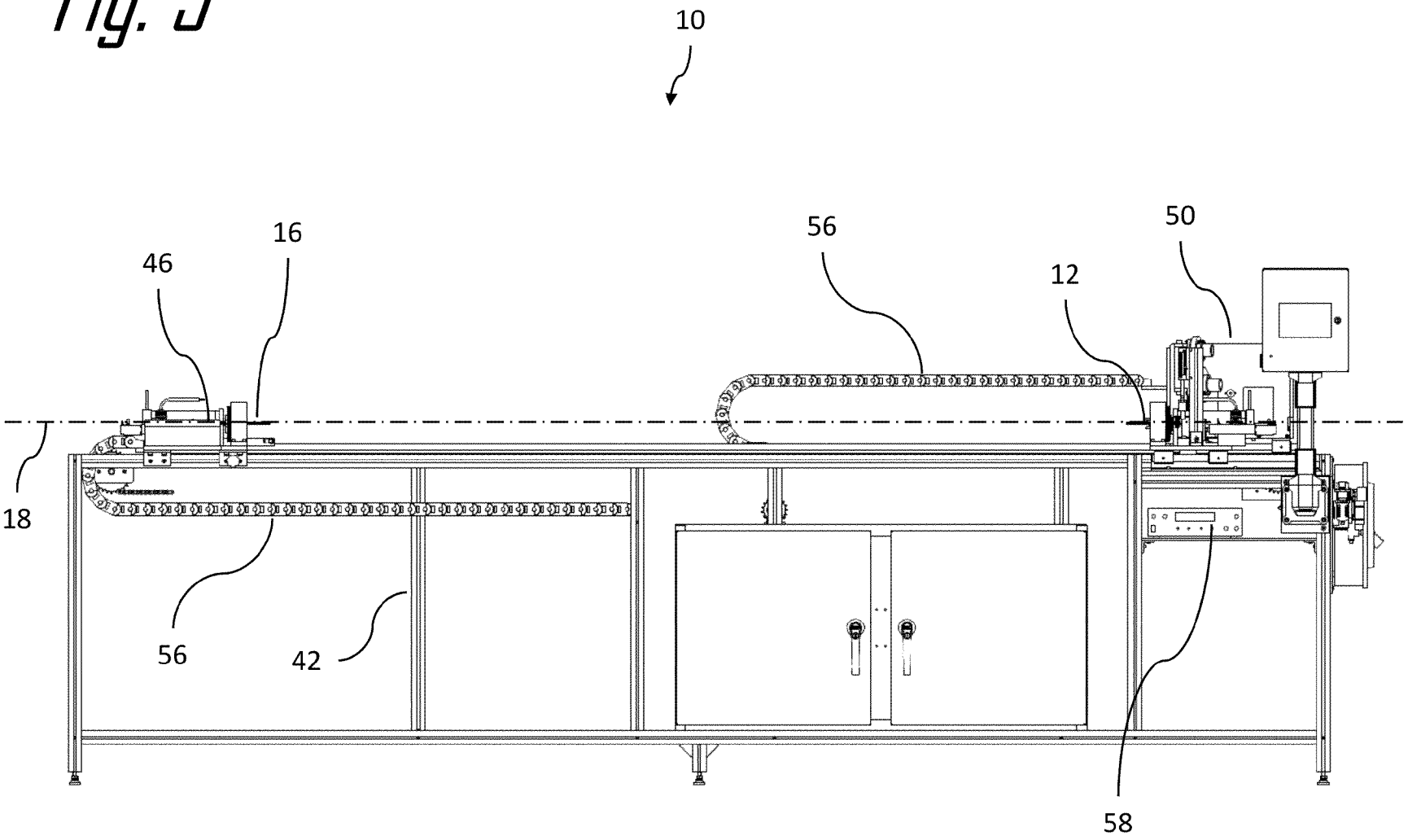
FIG. 9 is a detailed front view of the apparatus of FIG. 1 in accordance with one embodiment.
Figure 10:
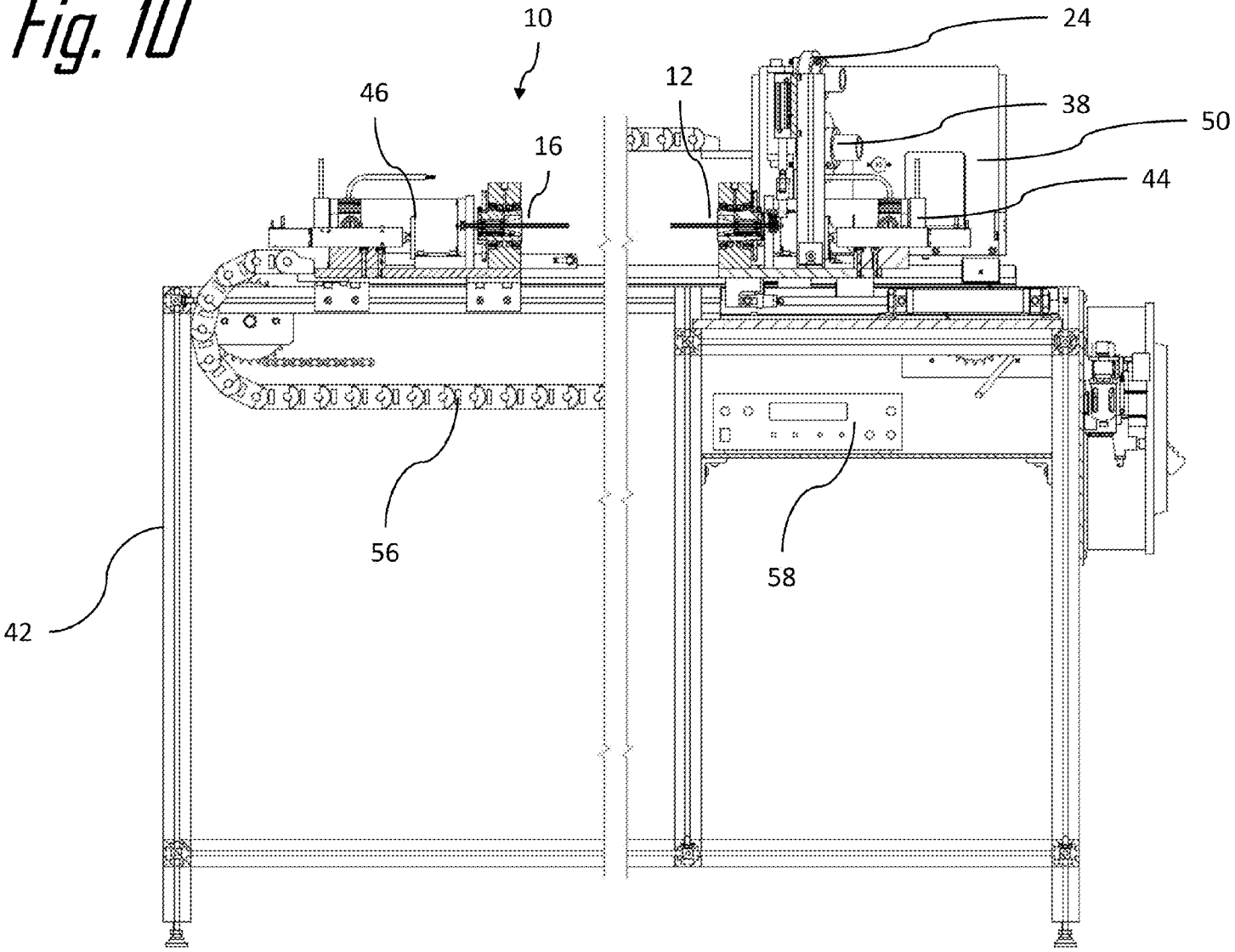
FIG. 10 is an end section of the detailed front view of FIG. 9 in accordance with one embodiment.

As shown in FIG. 5, the apparatus 10 also includes a second tape reel 40 that holds a second tape 38. The second tape reel 40 is preferably attached to the same transport mechanism (not shown in FIGS. 1-5) as the first tape reel 22 so that they move in tandem with the first tape reel 22. As illustrated in FIG. 5, the first and second tapes 24, 38 are attached to the wire pair 14 and as the wire pair 14 rotates and the first and second tape reels 22, 40 move from the second location 30 near the first clamp 12 to the first location 28 near the second clamp 16, thereby wrapping the first and second tape 24, 38 around the wire pair 14. The first tape 24 is a flexible insulative tape, such as a vinyl tape. The first tape 24 may or may not have an adhesive backing. The second tape 38 is a flexible conductive material, such as aluminized biaxially-oriented polyethylene terephthalate (PET) film or tape. This tape is commonly known by the trade name MYLAR and the aluminized PET tape will hereafter be referred to as MYLAR tape. The first and second tape reels 22, 40 are arranged so that the conductive second tape 38 is applied in direct contact with the drain wire 32 and the insulative first tape 24 is applied over the second tape 38.

As illustrated in FIGS. 6 through 10, the apparatus 10 includes a frame 42 on which the components are mounted. The first and second clamps 12, 16 are individually rotated by a pair of servo motors 44, 46 that are coupled to and controlled by an apparatus 10 controller (not shown). The controller determines the number of rotations, rotational direction 20 and speed of the pair of servo motors 44, 46 to produce the desired pitch of the twisted wire pair 14 and to synchronize the rotation of the first and second clamps 12, 16 to rotate the twisted wire pair 14. A third servo motor 52 is attached to the transport mechanism 50. The third servo motor 52 is also coupled to and controlled by the controller to synchronize the movement of the first and second tape reels 22, 40 while the twisted wire pair 14 is rotated in order to control the pitch and overlap of the tapes as they are applied to the twisted wire pair 14.

The transport mechanism 50 is attached to a pair of guide rails 54 located generally parallel to the axis 18 of the first and second clamps 12, 16 that guide the transport mechanism 50 and thus the first and second tape reels 22, 40 along the axis 18 of the first and second clamps 12, 16. The first clamp 12 is mounted to a fixed location on the frame 42 while the second clamp 16 may be located at different locations along the frame 42 to accommodate wire harness assemblies of different length. The controller is housed within an enclosure attached to the frame 42. The apparatus 10 includes flexible cable trays 56 to carry the power and signal wires (not shown) to the second clamp servo motor 46 and transport mechanism servo motor 52.

The apparatus 10 further includes an electrical continuity tester 58 which is configured to check the electrical continuity of the wire pair 14 and drain wire 32 after the first and second tapes 24, 38 are applied to the twisted wire pair 14. The tester may also check for short circuits between the wires of the twisted wire pair 14 to the drain wire 32.

Figure 11:
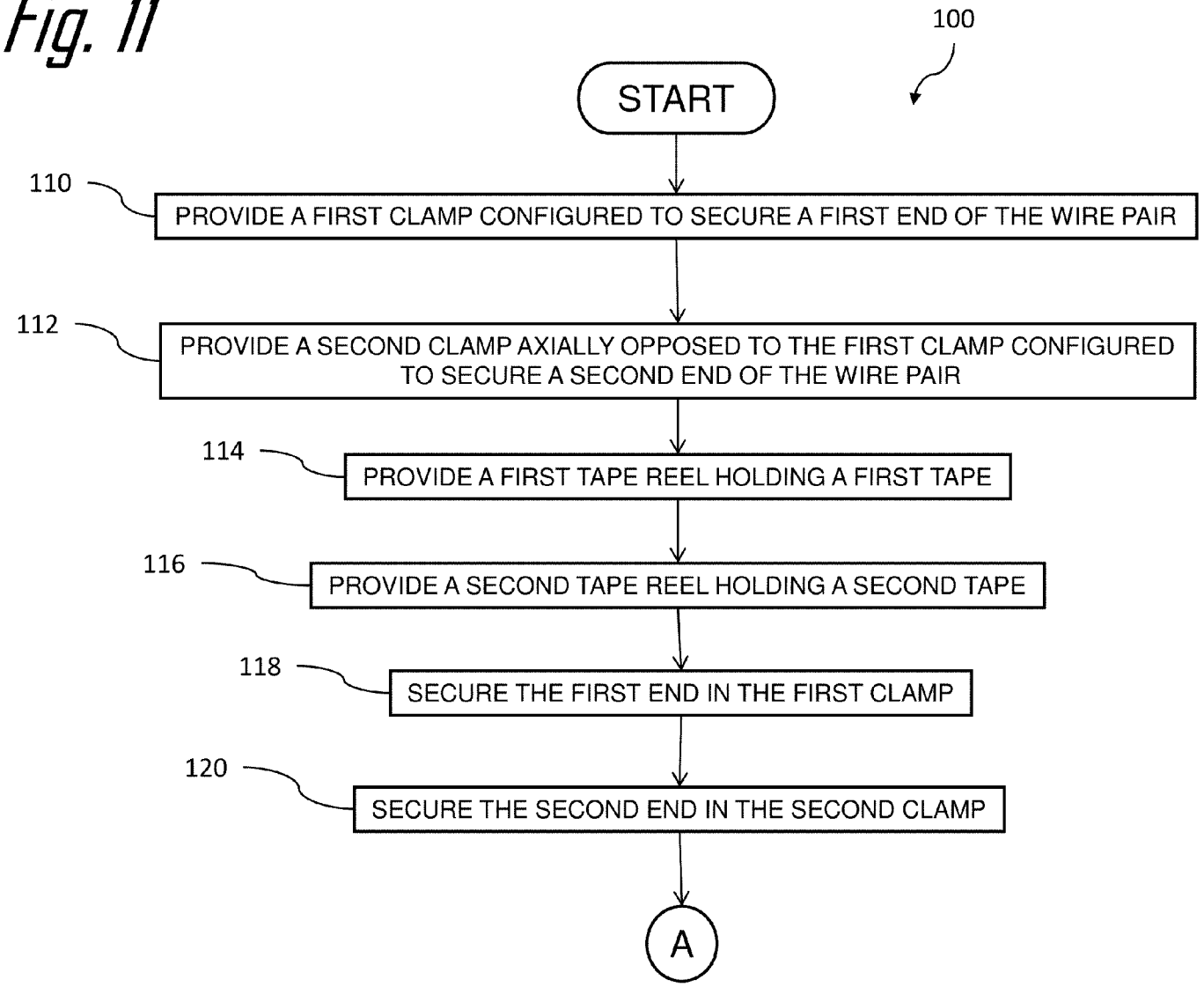
FIG. 11 is a flowchart of a method of manufacturing a wire cable assembly including an insulated twisted wire pair and an uninsulated drain wire having a first and second tape spirally wrapped about said wire pair in accordance with one embodiment.

FIG. 11 illustrates a method 100 of manufacturing a wire cable assembly including an insulated twisted wire pair 14 having an insulative first tape 24 spirally wrapped about said wire pair 14 and optionally including an uninsulated drain wire 32 and a second conductive second tape 38 spirally wrapped about said wire pair 14. The apparatus 10 described supra may be manufactured according to this method 100.

In step 110, PROVIDE A FIRST CLAMP CONFIGURED TO SECURE A FIRST END OF THE WIRE PAIR, a first clamp, such as the first clamp 12 described supra is provided.

In step 112, PROVIDE A SECOND CLAMP AXIALLY OPPOSED TO THE FIRST CLAMP CONFIGURED TO SECURE A SECOND END OF THE WIRE PAIR, a second clamp, such as the second clamp 16 described supra is provided axially opposed to the first clamp 12.

In step 114, PROVIDE A FIRST TAPE REEL HOLDING A FIRST TAPE, a first tape reel, such as the first tape reel 22 described supra is provided. The first tape may be a flexible insulative tape, such as the first tape 24 described supra.

In step 116, PROVIDE A SECOND TAPE REEL HOLDING A SECOND TAPE, a second tape reel, such as the second tape reel 40 described supra is provided. The second tape may be a flexible conductive tape, such as the second tape 38 described supra.

In step 118, SECURE THE FIRST END IN THE FIRST CLAMP, one end of the wire pair 14 is secured in the first clamp 12.

In step 120, SECURE THE SECOND END IN THE SECOND CLAMP, the other end of the wire pair 14 is secured in the second clamp 16.

In step 122, ROTATE THE SECOND CLAMP WHILE FIXING THE POSITION OF THE FIRST CLAMP, the second clamp 16 is rotated in the direction 20 while holding the position of the first clamp 12 so that it will not rotate thereby twisting the wires of the wire pair 14 one about the other.

In step 124, ROTATE THE SECOND CLAMP IN THE OPPOSITE DIRECTION, the second clamp 16 may be rotated in the direction 60 opposite to the direction 20 in which the wire pair 14 was twisted in order to relieve strain in the twisted wire pair 14 caused by the twisting. The second clamp 16 is preferably rotated less than two revolutions in the opposite direction 60 in this step 124.

In step 126, SECURE AN UNINSULATED WIRE IN THE FIRST AND SECOND CLAMPS IN ADDITION TO THE WIRE PAIR, an uninsulated drain wire 32 is secured within the first and second clamps 12, 16 in addition to the now twisted wire pair 14. The drain wire 32 may be secured in the second clamp 12 and applied to the wire pair 14 from a drain wire spool 34 attached to the transport mechanism 50 as the transport mechanism 50 moves in a lateral direction 36 from a first position near the second clamp 12 to a second position near the first clamp 12. The drain wire 32 is then cut from the drain wire spool 34 and the cut end is inserted in the first clamp 12.

In step 128, ATTACH THE FIRST TAPE TO THE WIRE PAIR IN A LOCATION PROXIMATE THE FIRST CLAMP, an end of the first tape 24 is attached to the wires of the wire pair 14 in a first location 28 near the first clamp 12. The first tape 24 may be attached to the wire pair 14 by an adhesive tape or tie wrap.

In step 130, ATTACH THE SECOND TAPE TO THE WIRE PAIR IN A LOCATION PROXIMATE THE FIRST CLAMP, an end of the second tape 38 is attached to the wires of the wire pair 14 near the first clamp 12. The second tape 34 may be attached to the wire pair 14 by an adhesive tape or tie wrap.

In step 132, ROTATE THE FIRST CLAMP AND ROTATE THE SECOND CLAMP SYNCHRONOUSLY WITH THE ROTATION OF THE FIRST CLAMP, the first clamp 12 is rotated in synchronization with the second clamp 16, thereby rotating the wire pair 14 and the drain wire 32 without further twisting the wire pair 14 or the drain wire 32.

In step 134, MOVE THE FIRST TAPE REEL GENERALLY PARALLEL TO THE AXIS OF THE FIRST AND SECOND CLAMPS AS THEY ROTATE SYNCHRONOUSLY, coincidental with step 130, the first tape reel 22 is moved in a lateral direction 26 generally parallel to the axis 18 of the first and second clamps 12, 16, thereby spirally wrapping the first tape 24 about the twisted wire pair 14. The first tape reel 22 is moved from a location near one of the clamps to a location near the other clamp. The speed at which the first and second clamp 16 rotate and the speed at which the first tape reel 22 moves parallel to the axis 18 determines the pitch or overlap of the first tape 24 as it is wrapped.

In step 136, MOVE THE SECOND TAPE REEL IN TANDEM WITH THE FIRST TAPE REEL, the second tape reel 40 is moved in tandem with the first tape reel 22 thereby spirally wrapping the second tape 38 about the twisted wire pair 14.

In step 138, CUT THE FIRST AND SECOND TAPE, after the first and second tapes 24, 38 are wrapped about the twisted wire pair 14, the first and second tapes 24, 38 are cut from the first and second tape reels 22, 40.

In step 140, SECURE THE CUT ENDS OF THE FIRST AND SECOND TAPE TO THE WIRE PAIR, the cut ends of the first and second tape 24, 34 are secured to the wire pair 14, e.g. by use of a tie wrap, adhesive tape, or hot melt glue.

In step 142, CHECK ELECTRICAL CONTINUITY OF THE WIRE PAIR AND UNINSTALLED WIRE, the wire pair 14 and the drain wire 32 are tested for electrical continuity and short circuits between the wires.

A single apparatus 10 configured to manufacture a wire cable assembly including an insulated twisted wire pair 14 having a tape spirally wrapped about said wire pair 14 and a method 100 of manufacturing a wire cable assembly including an insulated twisted wire pair 14 having a tape spirally wrapped about said wire pair 14 using the apparatus 10 is provided. The apparatus 10 may be further configured to manufacture a twisted pair wire cable assembly that includes an uninsulated drain wire 32 and has a conductive tape and an insulative tape spirally wrapped about said wire pair 14. The apparatus 10 provides the benefits of producing the wire cable assemblies on a single machine, thus eliminating in-process inventory required by manufacturing the wire assemblies on multiple machines as described in the Background of the Invention. This reduces the cost of in-process inventory and eliminates damage caused by handling between two or more machines. The apparatus 10 does not include feed wheels, so damage to the wire cable assemblies caused by pressure of feed wheels is also eliminated. Also, the apparatus 10 does not require the drain wire 32 to be pulled through the tape wrapping machine as described in the Background of the Invention. This eliminates the possibility of the drain wire 32 tangling with the twisted wire pair 14 and damaging the insulation of the twisted wire pair 14.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A method of manufacturing a wire cable assembly including an insulated twisted wire pair having a tape spirally wrapped about said wire pair, said method comprising:

providing a first clamp configured to secure a first end of the wire pair;

providing a second clamp axially opposed to the first clamp configured to secure a second end of the wire pair;

providing a first tape reel holding a first tape;

securing the first end in the first clamp;

securing the second end in the second clamp;

attaching an end of the first tape to the wire pair in a location proximate the first clamp;

rotating the second clamp while fixing the position of the first clamp, thereby twisting the wires of the wire pair one about the other and securing the end of the first tape within the wire pair;

rotating the first clamp;

rotating the second clamp synchronously with the rotation of the first clamp thereby rotating the wire pair without twisting; and moving the first tape reel in a direction generally parallel to the axis of the first and second clamps as they rotate synchronously thereby wrapping the first tape around the wire pair.

2. The method according to claim 1, further comprising:

providing a second tape reel holding a second tape;

attaching an end of the second tape to the wire pair in the location proximate the first clamp;

rotating the second clamp while fixing the position of the first clamp, thereby securing the end of the second tape within the wire pair; and moving the second tape reel in tandem with the first tape reel from a location proximate the first clamp to a location proximate the second clamp thereby wrapping the second tape around the wire pair.

3. The method according to claim 2, further comprising the steps of:

cutting the first and second tape following the step of moving the second tape reel in tandem with the first tape reel; and securing the cut ends of the first and second tape to the wire pair.

4. The method according to claim 2, wherein the first tape is an electrically conductive tape and the second tape is a dielectric tape.

5. The method according to claim 1, further comprising the step of:

securing an uninsulated drain wire in the first and second clamps in addition to the wire pair following the step of rotating the second clamp while fixing the position of the first clamp.

6. The method according to claim 5, further comprising:

checking electrical continuity of the wire pair and the drain wire following the step of moving the first tape reel in a direction generally parallel to the axis of the first and second clamps.

7. The method according to claim 1, further comprising:

rotating the second clamp in the opposite direction, thereby relieving wire stress in the wire pair following the step of rotating the second clamp while fixing the position of the first clamp.

8. An apparatus configured to manufacture a wire cable assembly including an insulated twisted wire pair having a tape spirally wrapped about said wire pair, said apparatus comprising:

a first clamp to secure a first end of the wire pair and to rotate or maintain a fixed position;

a second clamp to secure a second end of the wire pair axially opposed to the first clamp, to rotate while the first clamp maintains the fixed position thereby twisting the wires of the wire pair one about the other, or to rotate synchronously with the rotation of the first clamp thereby rotating the wire pair without twisting; and a first tape reel holding a first tape and configured to move generally parallel to the axis of the first and second clamps when they rotate synchronously thereby wrapping the first tape around the wire pair.

9. The apparatus according to claim 8, further comprising a second tape reel holding a second tape and configured to move in tandem with the first tape reel thereby wrapping the second tape around the wire pair.

10. The apparatus according to claim 9, wherein the first tape is an electrically conductive tape and the second tape is a dielectric tape.

11. The apparatus according to claim 8, wherein the second clamp is further configured to maintain a fixed position and the first clamp is further configured to rotate while the second clamp maintains the fixed position thereby twisting the wires of the wire pair one about the other.

12. The apparatus according to claim 11, further comprising:

a first servo motor mechanically coupled to the first clamp and configured to rotate the first clamp; and a second servo motor mechanically coupled to the second clamp and configured to rotate the second clamp.

13. The apparatus according to claim 12, further comprising:

a third servo motor mechanically coupled to the first tape reel and configured to move the first tape reel in a direction generally parallel to the axis of the first and second clamps.

14. The apparatus according to claim 8, wherein the first and second clamps are further configured secure an uninsulated drain wire in addition to the wire pair.

15. The apparatus according to claim 14, further comprising an electrical continuity tester configured to check electrical continuity of the wire pair and drain wire after the first tape is applied.

* * * * *